US006821126B2

(12) United States Patent
Neidlein

(10) Patent No.: US 6,821,126 B2
(45) Date of Patent: Nov. 23, 2004

(54) ELECTROMECHANICAL CONNECTING DEVICE

(75) Inventor: Hermann Neidlein, Steinheim (DE)

(73) Assignee: Magcode AG (DE)

( * ) Notice: Subject to any disclaimer, the term of this patent is extended or adjusted under 35 U.S.C. 154(b) by 0 days.

(21) Appl. No.: 10/433,554

(22) PCT Filed: Dec. 11, 2001

(86) PCT No.: PCT/EP01/14503

§ 371 (c)(1),
(2), (4) Date: Jun. 4, 2003

(87) PCT Pub. No.: WO02/49161

PCT Pub. Date: Jun. 20, 2002

(65) Prior Publication Data

US 2004/0029405 A1 Feb. 12, 2004

(30) Foreign Application Priority Data

Dec. 14, 2000 (DE) ..... 100 62 172.4

(51) Int. Cl.[7] ..... H01R 1/30
(52) U.S. Cl. ..... 439/38
(58) Field of Search ..... 439/38, 39, 40

(56) References Cited

U.S. PATENT DOCUMENTS 5,401,175 A * 3/1995 Guimond et al. ..... 439/38
6,231,349 B1 * 5/2001 Bullinger et al. ..... 439/39
6,561,815 B1 * 5/2003 Schmidt ..... 439/38

* cited by examiner

*Primary Examiner*—P. Austin Bradley
*Assistant Examiner*—Briggitte R. Hammond
(74) *Attorney, Agent, or Firm*—Welsh & Katz, Ltd.

(57) ABSTRACT

An electromechanical connecting device comprises a current supply housing and a current tap housing, each with contact surfaces. The current supply housing is provided with a moving magnet carriage with current contacts. The magnet carriage on the current supply housing and on the current tap housing are both provided with magnets. A permanent magnet is arranged in the current supply housing on the side opposing the current tap housing. The current supply housing and the current tap housing may be forcibly connected and disconnected by a rotating device with a turning motion. The contact surfaces of the current supply housing and the current tap housing make contact earlier than the contact surfaces of the current supply housing and the magnet carriage on connection of the current supply housing and the current tap housing and on disconnection are in contact longer.

21 Claims, 3 Drawing Sheets

ELECTROMECHANICAL CONNECTING DEVICE

The invention relates to an electromechanical connecting device having a current supply housing and having a current tap housing, there being flat contacts in each case on mutually facing sides of the housing, the current supply housing being provided with current supply terminals and with a movable magnetic carriage with current contact points which are connected to the current supply terminals, a permanent magnet being arranged in the current supply housing on the side facing away from the current tap housing, the magnetic carriage of the current supply housing and the current tap housing in each case being provided with magnets which are arranged in such a way that, when current supply housing and current tap housing are placed on each other, in each case magnets of different polarity are arranged opposite one another, as a result of which the current contact points of the magnetic carriage produce a connection to the flat contacts of the current supply housing, counter to the retaining force of the permanent magnet, and therefore also produce the current connection to the flat contacts in the current tap housing.

A generic electromechanical connecting device is disclosed by WO 98/0934.

In relation to the previous prior art, reference is also made to WO 97/50152.

As a result of the current supply housing and current tap housing being placed on each other, on account of the magnets of the magnetic carriage of the current supply housing and the magnets of the current tap housing, the magnetic carriage is moved counter to the retaining force of the permanent magnet in such a way that a connection is produced to the flat contacts of the current supply housing and therefore also a current connection to the flat contacts in the current tap housing.

In this case, for specific areas of application, it is disadvantageous that the magnetic carriage already move in the direction of the flat contacts of the current supply housing and reaches said contacts before contact has been made between the flat contacts of the current supply housing and the current tap housing. The result of this is that the flat contacts of the current supply housing are already live before the flat contacts of the current tap housing are connected to them. As a result, an arc can be produced between the flat contacts. In a manner analogous to this, when the current tap housing is separated from the current supply housing, a separating spark can be produced.

For various areas of application, in particular in the motor vehicle sector, an arc between the flat contacts has proven to be disadvantageous. In particular also from safety considerations, an open or visible arc or separating spark is not desired, in particular in motor vehicles. Furthermore, the easy detachability between the current supply housing and current tap housing may be disadvantageous for specific areas of application of the electromechanical connecting device, although it is desired in other areas of application.

U.S. Pat. No. 3,521,216 discloses an electromechanical connecting device having magnets in a current tap housing and a current supply housing and having flat contacts in addition to a magnetic carriage, which is held in a hold-back position by spring force, it being possible for the current supply housing and the current tap housing to be connected to each other and disconnected forcibly over a turning travel by a rotating device.

The present invention is based on the object of finding a solution to the aforementioned disadvantages of the prior art, in particular preventing an open arc or separating spark between the flat contacts of the current supply housing and the current tap housing and, for appropriate areas of application, providing a connection which can be more highly loaded.

According to the invention, this object is achieved in that the current supply housing and the current tap housing can be forcibly connected to each other and disconnected by a rotating device via a turning motion, the rotating device having an entry/exit region and current contact region, between which the current supply housing and the current tap housing can be rotated in relation to each other, the entry/exit region being arranged in such a way that the magnets of the current tap housing and of the magnetic carriage of the current supply housing are offset in relation to one another in such a way that the magnetic carriage does not rest on the flat contacts of the current supply housing, the flat contacts of the current supply housing and/or of the current tap housing at least approximately having the shape of a circular arc, as a result of which the flat contacts of the current supply housing and of the current tap housing make contact earlier when current supply housing and current tap housing are connected and are in contact longer during their disconnection than the flat contacts of the current supply housing with the current contact points on the magnetic carriage.

The fact that the current supply housing and the current tap housing are forcibly connected by a rotating device advantageously means that the flat contacts of the current supply housing and of the current tap housing are connected before the current contact points on the magnetic carriage are in contact with the flat contacts of the current supply housing. This is possible since the magnets of the magnetic carriage and of the current tap housing are arranged in relation to one another only at the end of the rotary movement such that in each case magnets of different polarity are arranged opposite one another. Only in this position or, depending on the configuration, in a position adjacent thereto does the magnetic carriage move in the direction of the flat contacts of the current supply housing or bear on the latter, counter to the retaining force of the permanent magnet. At this time, however, the flat contacts of the current supply housing and of the current tap housing are already connected to one another, so that no arc can be produced between these. An arc can possibly be produced only between the current contact points on the magnetic carriage and the flat contacts of the current supply housing, and therefore internally.

When the current supply housing is separated from the current tap housing, the rotary movement or the rotating device ensures in an analogous manner that, firstly, the position of the magnets of the magnetic carriage in relation to the magnets of the current tap housing is changed in such a way that the magnetic carriage or the current contact points on the magnetic carriage are separated from the flat contacts of the current supply housing and only then is the contact between the flat contacts of the current supply housing and of the current tap housing interrupted. Consequently, the current tap housing is removed from the current supply housing only when the magnetic carriage has already moved in the direction of the permanent magnet or has arrived in the end position of this movement. A separating spark between the flat contacts of the current supply housing and of the current tap housing is thus ruled out. A separating spark of this type can be produced, likewise in a manner analogous to the arc during connection, only between the current contacts of the magnetic carriage and the flat contacts of the current supply housing, and thus likewise internally in the current supply housing.

For specific areas of application, the rotating device can be configured in such a way that inadvertent separation or easy disconnection of the current tap housing from the current supply housing is prevented. In this case, provision can also be made for the connection between the current tap housing and the current supply housing to be capable of being disconnected with a defined tensile force from safety considerations, before damage occurs to other parts, in the form of an emergency unlocking means.

The circular arc shape of the flat contacts ensures that, during the rotary movement of the current supply housing and of the current tap housing in relation to each other, a connection between the respective flat contacts is produced or is maintained. The circular arc shape or the bean-like form of the flat contacts can in this case be selected with respect to their length such that it is ensured that the flat contacts of the current supply housing and of the current tap housing make contact earlier during connection and are in contact longer during disconnection than the flat contacts of the current supply housing with the current contact points on the magnetic carriage. In this case, provision can advantageously be made for the flat contacts to extend over an angle which corresponds to the rotational angle of the rotary movement.

According to the invention, provision is also made for the rotating device to have an entry/exit region and a current contact region, between which the current supply housing and the current tap housing can be rotated in relation to each other, the entry/exit region being arranged in such a way that the magnets of the current tap housing and of the magnetic carriage of the current supply housing are offset in relation to one another such that the magnetic carriage does not rest on the flat contacts of the current supply housing.

The fact that the rotating device has a defined entry/exit region and a current contact region means that the device according to the invention can be handled safely and without faults in a particularly straightforward manner.

The arrangement of the entry/exit region ensures that, when the current tap housing is fitted to the current supply housing, only a contact between the flat contacts is produced, since the magnets of the magnetic carriage and of the current tap housing are offset in relation to one another in this region such that, if appropriate including the retaining force of the permanent magnet, it is ensured that the magnetic carriage does not rest on the flat contacts of the current supply housing. As a result of the rotary movement of the current supply housing and the current tap housing in the direction of the current contact region, on account of the magnets of the magnetic carriage and of the current tap housing, a movement of the magnetic carriage in the direction of the flat contacts of the current supply housing then takes place, which produces the desired current connection.

In a development of the invention, provision can be made for the magnets of the current tap housing and of the magnetic carriage of the current supply housing to be arranged in the entry/exit region in such a way that, because of the magnetic action, an automatic rotary movement of the current supply housing and of the current tap housing to the current contact region takes place.

This advantageously means that, after the current tap housing has been connected to the current supply housing, a desired current connection is produced in the entry/exit region without further measures being necessary. The current tap housing may be connected to the current supply housing advantageously and in a user-friendly manner. Furthermore, as a result of the automatic rotary movement, faulty operation is ruled out. Since the automatic rotary movement takes place on account of the magnetic action between the magnets of the current tap housing and the magnets of the magnetic carriage, an additional, possibly battery-operated device is not necessary is [sic]. As a result of the automatic rotary movement of the current supply housing and of the current tap housing, the operator additionally recognizes the fact that the current supply housing and the current tap housing have been connected to each other correctly by him or her.

It is advantageous if the rotating device is constructed as a bayonet-like closure.

Configuring the rotating device as a bayonet-like closure has proven to be particularly suitable with respect to the possibly desired connection security between the current supply housing and the current tap housing, cost-effective and simple production and the ability to be operated simply.

According to the invention, provision can further be made for the current tap housing and the current supply housing to have differently polarized magnets for different voltages, in particular 12 volts and 24 volts, in such a way that the magnetic fields of the 12-volt current tap housing and the 12-volt current supply housing and of the 24-volt current tap housing and the 24-volt current supply housing are oppositely polarized. This ensures that, if the 12-volt current tap housing, for example, is fitted wrongly, no automatic rotary movement between a 24-volt current supply housing and the 12-volt current tap housing takes place, or the magnetic carriage is not attracted by the magnets of the 12-volt current tap housing.

Advantageous developments and refinements of the invention emerge from the further subclaims and from the exemplary embodiments, illustrated in principle below using the drawing, in which:

Figure 1:
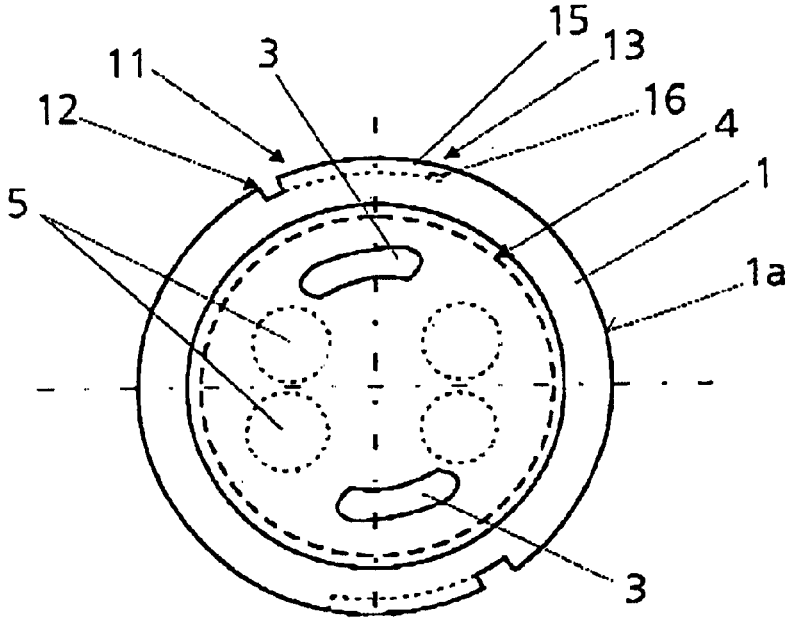
FIG. 1 shows a plan view of a current supply housing with circular arc shaped flat contacts and with an integrated magnetic carriage with magnets, indicated dashed.
Figure 2:
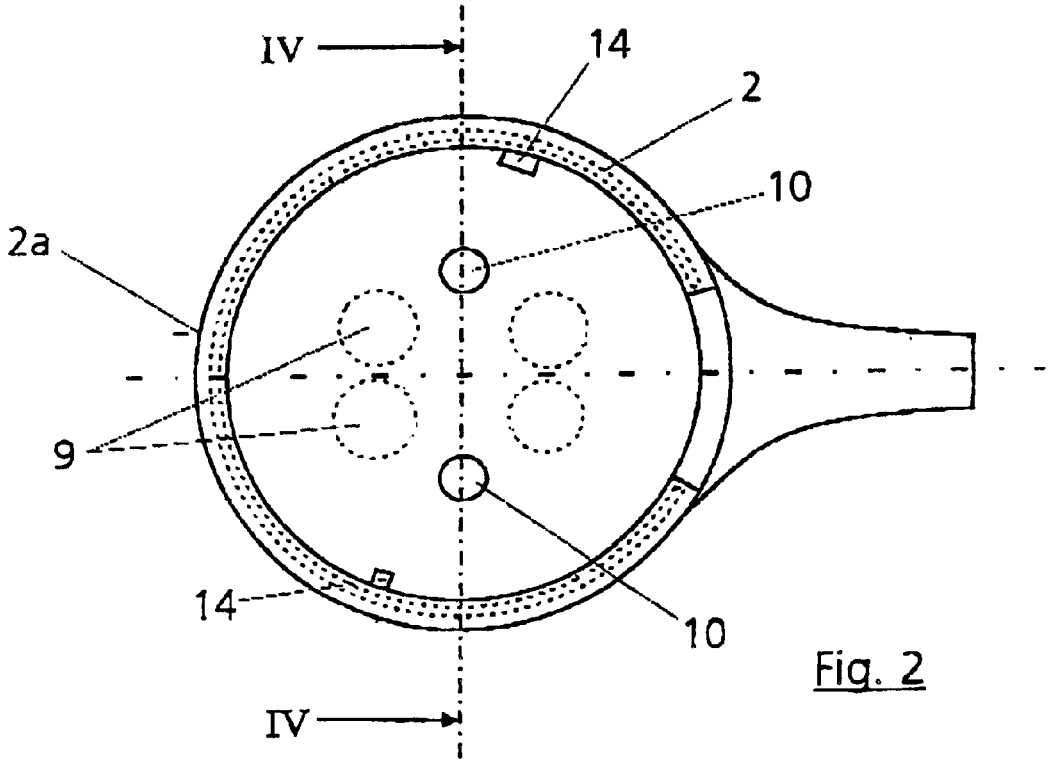
FIG. 2 shows a current tap housing with magnets indicated.

The electromechanical connecting device according to the invention has a current supply housing 1 illustrated in FIG. 1 and a current tap housing 2 illustrated in FIG. 2. The basic function of the electromechanical connecting device is already known, for example from WO 97/50152 and WO 98/09346. In the following text, accordingly, only the features relevant to the achievement of the object according to the invention will be discussed.

As can be seen from FIG. 1, on its housing side facing the current tap housing 2 or upper side, the current supply housing 1 has flat contacts 3 which, in the exemplary embodiment illustrated, are of arcuate design. Furthermore, the current supply housing 1 has a movable magnetic carriage 4, merely indicated dashed, having four magnets 5 likewise indicated only dashed.

Figure 3:
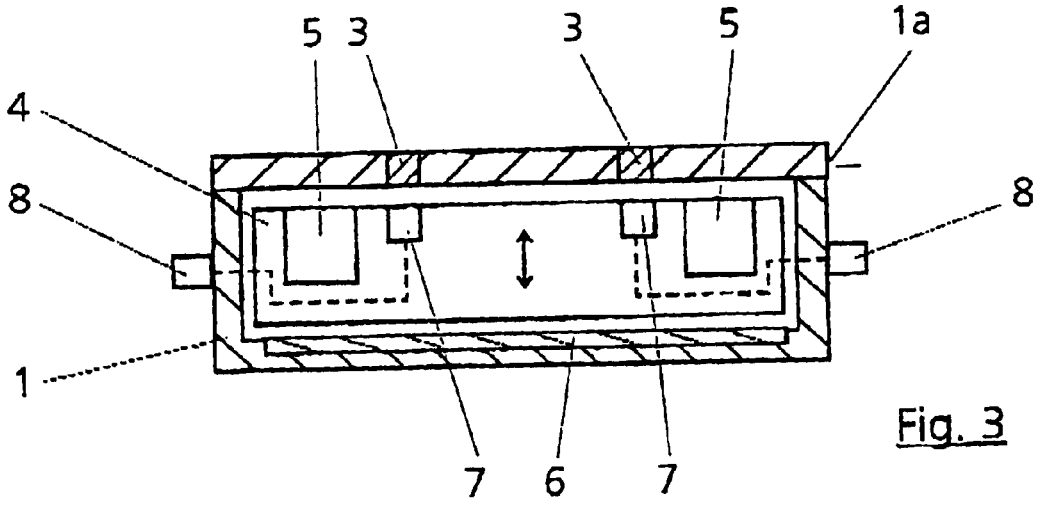
FIG. 3 shows a section through a current supply housing with a magnetic carriage, magnets, current contact points, current supply terminals and a permanent magnet, illustrated in principle.

Since the basic structure of the current supply housing 1 is already known from the aforementioned specifications and prior art, the necessary parts are merely indicated in principle in FIG. 3 and their function described for general understanding.

As can be seen in FIG. 3, the magnetic carriage 4 with the magnets 5 can move within the current supply housing 1. Here, the magnetic carriage 4 is attracted by a permanent magnet 6 in such a way that the magnetic carriage 4 rests on the permanent magnet 6 if the current tap housing 2 is not connected to the current supply housing 1. The magnetic carriage 4 has current contact points 7, which are connected to current supply terminals 8. If the current supply housing 1 is connected to the current tap housing 2 and the magnets 5 correspond appropriately to the magnets 9 illustrated in FIG. 2 and belonging to the current tap housing 2, the magnetic carriage 4 is lifted off the permanent magnet 6 and moved in the direction of the flat contacts 3 of the current supply housing 1. As soon as the current contact points 7 bear on the flat contacts 3 of the current supply housing 1, the current can be led from the flat contacts 3 of the current supply housing 1 to flat contacts 10 of the current tap housing 2. As already mentioned above, with respect to the exact function, reference is made to the prior art and the two specifications cited.

As can be seen from FIG. 1 and FIG. 2, the current supply housing 1 and the current tap housing 2 are forcibly connected to each other and disconnected via a turning motion. For this purpose, the current supply housing 1 has a rotating device 11. Of course, as an alternative to this, the current tap housing 2 can also have a rotating device 11 or the rotating device 11 can be formed in two parts.

The rotating device 11 has an entry/exit region 12 and a current contact region 13, between which the current supply housing 1 and the current tap housing 2 can be rotated in relation to each other. The entry/exit region 12 is in this case arranged in such a way that the magnets 5 of the magnetic carriage 4 and the magnets 9 of the current tap housing 2 are offset in relation to one another such that the magnetic carriage 4 is not moved in the direction of the flat contacts 3 during connection and no longer rests on the flat contacts 3 during disconnection. Moreover, the entry/exit region 12 is selected in such a way that the flat contacts 10 are in contact with the flat contacts 3 and this contact is maintained during the entire turning motion between the current contact region 13 and the entry/exit region 12. This achieves a situation where the flat contacts 3 and 10 of the current supply housing 1 and of the current tap housing 2 make contact earlier when current supply housing 1 and current tap housing 2 are connected and are in contact longer during their disconnection than the flat contacts 3 of the current supply housing 1 with the current contact points 7 on the magnetic carriage 4.

In a manner not illustrated, this can also be achieved by the flat contacts 10 of the current tap housing 2 extending at least approximately over the length of the turning motion of the rotating device 11. Of course, in a further alternative refinement, both flat contacts 3, 10 can also be designed in such a way that they extend over the entire length of the turning motion.

As can be seen from FIGS. 1 and 2, the entry/exit region 12 is selected in such a way that the current supply housing 1 and the current tap housing 2 execute an automatic turning motion in the direction of the current contact region 13 because of the magnetic action of the magnets 5 and the magnets 9. This can be achieved in a straightforward manner by means of a partial overlap of the magnets 5 and of the magnets 9 with different polarities. In this case, the overlap has to be selected in such a way that, although the magnetic action is sufficient to initiate an automatic turning motion, it is too low to overcome the magnetic force from the permanent magnet 6 acting on the magnetic carriage 4.

This means that, in the entry/exit region 12, the magnetic force from the permanent magnet 6 predominates as compared with the magnetic force between the magnets 5 and the magnets 9.

Provision can advantageously be made in this case for the rotating device 11 to have a turning motion through a rotational angle in such a way that the magnets 9 of the current tap housing and the magnets 5 of the magnetic carriage 4 repel or attract more weakly in the entry/exit region 12 than the retaining force of the permanent magnet 6, and attract in the current contact region 13. A rotational angle of 20° to 40°, preferably 30°, has proven to be a particularly advantageous rotational angle for this purpose.

In the current contact region 13, the magnetic action between the magnet 5 and the magnet 9 is so high that the magnetic carriage 4 produces a connection to the flat contacts 3 of the current supply housing 1 counter to the retaining force of the permanent magnet 6. The current contact region 13 therefore coincides with the region in which, in the prior art, the current tap housing 2 is placed on the current supply housing 1. The parts needed for this purpose are configured in this way, in particular including the magnetic carriage 4, with regard to the material selection.

As indicated in FIG. 1, the rotating device is constructed as a bayonet-like closure 11.

A particularly secure connection between the current supply housing 1 and the current tap housing 2 is possible, as illustrated in FIG. 1 and FIG. 2, as a result of the fact that the outer circumference 2*a* of the current tap housing 2 is constructed in such a way that, in the connecting region between the current tap housing 2 and the current supply housing 1, the current tap housing 2 encloses an adjacent outer circumference 1*a* of the current supply housing 1. It is therefore possible, in a straightforward way, for the current tap housing 2 to be formed in the connecting region with two inwardly directed pin-like projections 14, bolts, points, lugs, hooks or the like, which engage in a corresponding cutout 15 in the current supply housing 1.

The fact that the outer circumference 2*a* of the current tap housing 2 encloses the outer circumference 1*a* of the current supply housing 1 creates a particularly tight connection, in a simple way also a watertight connection, between the current supply housing 1 and the current tap housing 2. In trials, a connection by means of pin-like projections 14 and cutouts 15 corresponding thereto has proven to be capable of being produced and handled particularly simply. Furthermore, a connection which is play-free to a high extent may be produced as a result. The pin-like projections 14 may be introduced in a straightforward way into the entry/exit region 12, which opens into the cutout 15, and displaced along the latter as far as the current contact region 13. A precision locking means 16 may advantageously be provided in the current contact region 13. The precision locking means 16 in this case permits particularly secure, wobble-free and play-free connection of the current supply housing 1 to the current tap housing 2.

Of course, in an alternative refinement, only one pin-like projection 14 or a large number thereof with appropriately corresponding cutouts 15 can also be provided. In this case, however, the embodiment illustrated, having two pin-like projections 14, is particularly advantageous.

Figure 4:
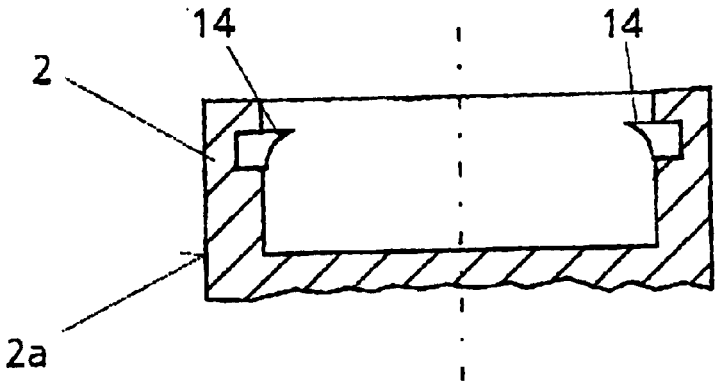
FIG. 4 shows a section through the current tap housing according to the line IV—IV from FIG. 2 in a first embodiment.

As FIG. 4 reveals, the pin-like projections 14 can be injection-molded, for example, in a particularly cost-effective refinement. Of course, any other desired technique for fitting the pin-like projections 14 is also possible. In this case, it is advantageous if the pin-like projections 14 or the like have an elongate form which, in the connecting region, tapers or has a bevel from that side of the current tap housing 2 which faces the current supply housing 1 or the upper side of the current tap housing 2 in the direction of an underside of the housing (FIG. 4). The wedge-like configuration makes it possible for the current tap housing 2 to be widened under a definable tensile loading and thus for the current tap housing 2 to be detached from the current supply housing 1 without a turning motion having to be introduced manually. This measure serves to prevent damage to the electromechanical connecting device. The wedge-like shape or the bevel of the pin-like projections 14 in this case assist widening of the current tap housing 2. The current tap housing 2 and the pin-like projections 14 are in this case configured such that forceful disconnection of this type takes place only in an emergency.

Alternatively, or as a supplement to this, the current tap housing 2 can be formed from a resilient or compliant material. This also means that, in an emergency, forceful separation of the current supply housing 1 from the current tap housing 2 may be achieved.

Figure 5:
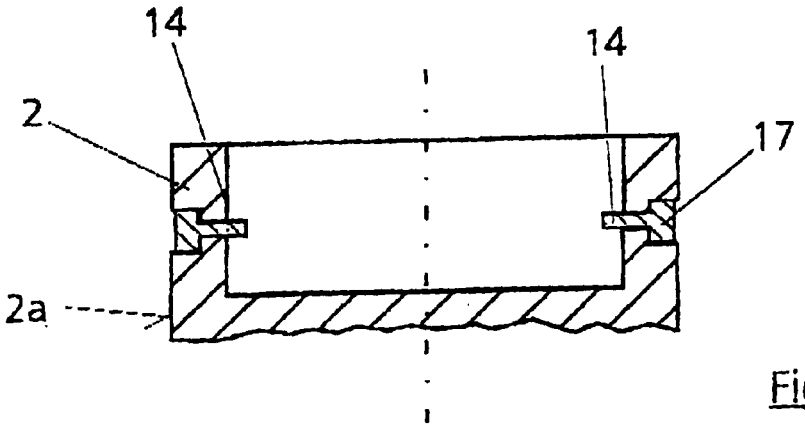
FIG. 5 shows a section through the current tap housing according to the line IV—IV from FIG. 2 in a second embodiment.

A further alternative arrangement of the pin-like projections 14 is illustrated in FIG. 5. In this case, provision is made for the current tap housing 2 to be surrounded on its outer circumference 2*a* by a ring 17, on which the pin-like projections 14 are arranged. The pin-like projections 14 in this case project inward through corresponding holes in the outer wall 2*a*. As has transpired in trials, the outer circumference 2*a* can be provided with the ring 17 in an advantageous, simple and cost-effective manner.

Provision can also be made here for the outer circumference 2*a* to have a circumferential cutout which is matched to the ring in order to accommodate the ring 17. Firstly, a uniform outer surface of the current tap housing 2 is achieved as a result, secondly the ring 17 is guided in an advantageous way. In order to permit forcible disconnection in emergencies, the ring can in this case be formed appropriately resiliently.

For this purpose, it is advantageous if the ring 17 has a closed form, so that the ring 17 can be bent up in a simple manner when a defined tensile loading is applied. This may be implemented in a simple way by the ring 17 having a gap instead of a closed circular form. This has proven to be particularly advantageous as well with regard to fitting the ring 17 to the outer circumference 2*a*. Of course, the pin-like projections fitted to the ring 17 can be configured in exactly the same way as the wedge-like projections 14 already described.

Figure 6:
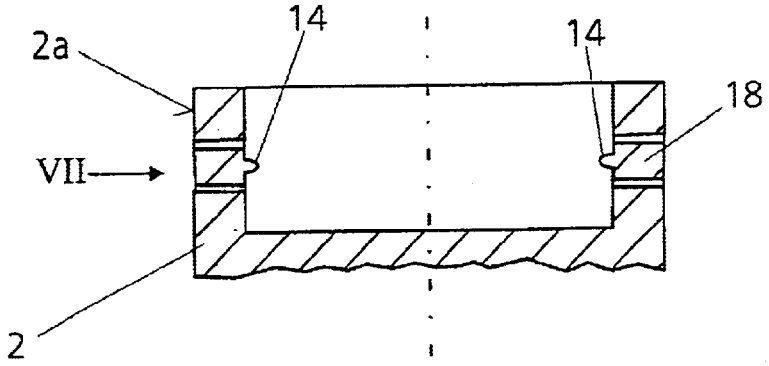
FIG. 6 shows a section through the current tap housing according to the line IV—IV from FIG. 2 in a third embodiment.
Figure 7:
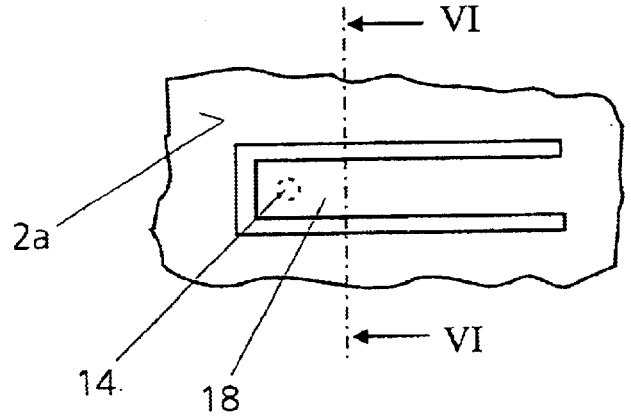
FIG. 7 shows an enlarged illustration of a tongue cut into the outer circumference of the current tap housing and provided with pin-like projections, according to the view VII of FIG. 6.
Figure 8:
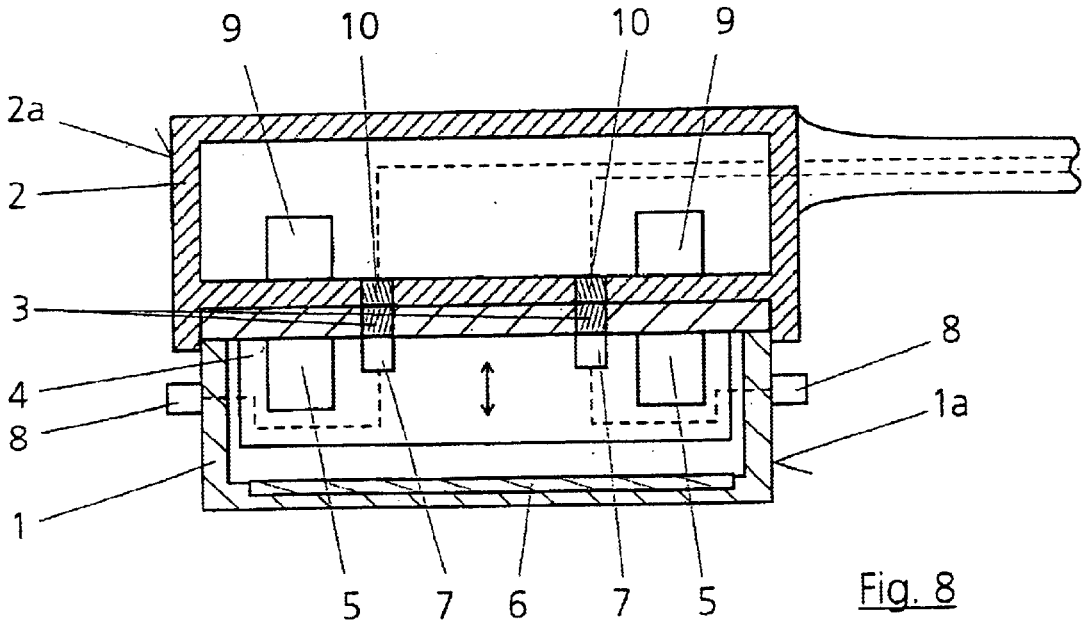
FIG. 8 is a cutaway view showing the supply housing and the tap housing secured together.

A further arrangement of the pin-like projections 14, illustrated in FIG. 6, can consist in the outer circumference 2*a* of the current tap housing 2 having resilient tongues 18. In this case, the resilient tongues 18 can be cut or milled in a simple manner into the material of the outer circumference 2*a*. As already described with respect to FIGS. 4 and 5, the tongues 18 also bend up when an appropriately high tensile loading occurs, so that the current tap housing 2 is separated from the current supply housing 1. An enlarged illustration of the tongues 18 can be seen in FIG. 7.

As can be seen in FIG. 2, the pin-like projections 14 illustrated can have various dimensions, to which the entry/exit regions 12 and the cutouts 15 illustrated in FIG. 1 are matched appropriately in terms of their opening width. The pin-like projections 14 of different sizes ensure that the current tap housing 2 can be connected to the current supply housing 1 only in one position. In a position rotated through 180°, a pin 14 with a large diameter would encounter an entry/exit region 12 which cannot accommodate it. Wrong connection is ruled out as a result.

In order to prevent a current tap housing 2 being placed on a current supply housing 1 which has been designed for a different voltage, the current tap housing 2 and the current supply housing 1 with different voltages can have differently polarized magnets 9 and 5. This applies in particular to current tap housings 2 and current supply housings 1 with 12-volt or 24-volt voltage, which are often used in the motor vehicle sector. Provision can be made in this case for the magnetic fields of the 12-volt current tap housing 2 and the 12-volt current supply housing 1 and of the 24-volt current tap housing and the 24-volt current supply housing 1 to be oppositely polarized. In connection with the pin-like projections of different sizes, this ensures that, even if the operator fits a wrong current tap housing 2, the magnetic carriage 4 is not attracted or is even repelled because of the opposite polarization. A flow of current is thus ruled out. Furthermore, after the wrong current tap housing 2 has been fitted, there is no automatic turning motion in the direction of the current contact region 13 either. Thus, even for the lay operator, it is possible to detect in a simple way that the wrong current tap housing 2 has been fitted.

In a simple and cost-effective manner, in order to distinguish the various current tap housings 2, the ring 17 can be identified appropriately in color or in another way, so that this refers to the appropriate voltage.

Particularly cost-effective and advantageous production of the device according to the invention is thus possible.

In one constructional refinement, the current supply housing 1 or the current tap housing 2 can be constructed in such a way that these can also be connected to conventional current tap housings 2 and current supply housings 1 (that is to say without a rotating device 11).

In an advantageous embodiment, provision can likewise be made for the switching speed of the magnetic carriage 4 also [sic] the magnetic force to be so high that contact can even be made with relatively high currents, for example 42 volts, or [sic] without destructive arc switches [sic]. For this purpose, the magnets 5, 9 and/or the permanent magnet 6 can be designed appropriately in a simple way.

What is claimed is:

1. An electromechanical connecting device having a current supply housing and having a current tap housing, there being flat contacts in each case on facing sides of the housing, the current supply housing being provided with current supply terminals and with a movable magnetic carriage with current contact points which are connected to the current supply terminals, a permanent magnet being arranged in the current supply housing on the side facing away from the current tap housing, the magnetic carriage of the current supply housing and the current tap housing in each case being provided with magnets which are arranged in such a way that, when current supply housing and current tap housing are placed on each other, in each case magnets of different polarity are arranged opposite one another, as a result of which the current contact points of the magnetic carriage produce a connection to the flat contacts of the current supply housing, counter to a retaining force of the permanent magnet, and therefore also produce the current connection to the flat contacts in the current tap housing, characterized in that the current supply housing and the current tap housing can be forcibly connected to each other and disconnected by a rotating device via a turning motion, the rotating device having an entry/exit region and a current contact region, between which the current supply housing and the current tap housing can be rotated in relation to each other, the entry/exit region being arranged in such a way that the magnets of the current tap housing and of the magnetic carriage of the current supply housing are offset in relation to one another such that the magnetic carnage does not rest on the flat contacts of the current supply housing, the flat contacts of the current supply housing or of the current tap housing at least approximately having a shape of a circular arc, as a result of which the flat contacts of the current supply housing or of the current tap housing make contact earlier when current supply housing and current tap housing are connected and are in contact longer during their disconnection than the flat contacts of the current supply housing with the current contact points on the magnetic carriage.

2. The electromechanical connecting device as claimed in claim 1, characterized in that the flat contacts of the current supply housing and/or of the current tap housing extend at least approximately over the length of the turning motion of the rotating device.

3. The electromechanical connecting device as claimed in claim 1, characterized in that the flat contacts of the current supply housing and of the current tap housing are in contact in the entry/exit region.

4. The electromechanical connecting device as claimed in claim 1, characterized in that the magnets of the current tap housing and of the magnetic carriage of the current supply housing are arranged in the entry/exit region in such a way that, because of the magnetic action, an automatic turning motion of the current supply housing and of the current tap housing to the current contact region takes place.

5. The electromechanical connecting device as claimed in claim 1, characterized in that the current contact points of the magnetic carriage produce a connection to the flat contacts of the current supply housing counter to the retaining force of the permanent magnet in the current contact region.

6. The electromechanical connecting device as claimed in claim 1, characterized in that the rotating device is constructed as a bayonet-like closure.

7. The electromechanical connecting device as claimed in claim 1, characterized in that a precision locking means is provided in the current contact region.

8. The electromechanical connecting device as claimed in claim 1, characterized in that the switching speed of the magnetic carriage 4 resulting from the magnetic force of the magnets and/or the permanent magnet is so high that even relatively high currents, in particular at 42 volts, can be switched without arcing.

9. The electromechanical connecting device as claimed in claim 1, characterized in that the rotating device exhibits a rotary movement through a rotational angle such that the magnets of the current tap housing and of the magnetic carriage repel or attract more weakly in the entry/exit region than the retaining force of the permanent magnet, and attract in the current contact region.

10. The electromechanical connecting device as claimed in claim 9, characterized in that the rotating device permits a rotary movement through a rotational angle of 20° to 40°, preferably 30°.

11. The electromechanical connecting device as claimed in claim 1, characterized in that the outer circumference of the current tap housing is constructed in such a way that, in the connecting region between the current tap housing and the current supply housing, the current tap housing encloses an adjacent outer circumference of the current supply housing.

12. The electromechanical connecting device as claimed in claim 11, characterized in that, in the connecting region, the current tap housing has at least two inwardly directed projections, bolts, points, lugs, or hooks which engage in corresponding cutouts in the current supply housing.

13. The electromechanical connecting device as claimed in claim 12, characterized in that the projections, bolts, points, lugs or hooks can be injection-molded.

14. The electromechanical connecting device as claimed in claim 12, characterized in that the projections, bolts, points, lugs or hooks have an elongate form which, in the connecting region, tapers or has a bevel from that side of the current tap housing which faces the current supply housing in the direction of an underside of the housing.

15. The electromechanical connecting device as claimed in claim 12, characterized in that the current tap housing is provided on its outer circumference with a ring, on which the projections, bolts, points, lugs or hooks are arranged.

16. The electromechanical connecting device as claimed in claim 12, characterized in that the current tap housing or the projections are formed from a resilient or compliant material.

17. The electromechanical connecting device as claimed in claim 12, characterized in that the projections, bolts, points, lugs or hooks have different dimensions, and the opening width of the respective associated entry/exit region is matched thereto.

18. The electromechanical connecting device as claimed in claim 12, characterized in that the outer circumference of the current tap housing has resilient tongues, on which the projections or the like are arranged.

19. The electromechanical connecting device as claimed in claim 18, characterized in that the tongues are cut or milled from the material of the outer circumference of the current tap housing.

20. The electromechanical connecting device as claimed in claim 1, characterized in that the current tap housing and/or the current supply housing have differently polarized magnets for different voltages, in particular 12 volts and 24 volts.

21. The electromechanical connecting device as claimed in claim 20, characterized in that the magnets of the 12-volt current tap housing and the 12-volt current supply housing and of the 24-volt current tap housing and the 24-volt current supply housing are oppositely polarized.

* * * * *